US006827009B2

(12) United States Patent
Koivukunnas et al.

(10) Patent No.: US 6,827,009 B2
(45) Date of Patent: Dec. 7, 2004

(54) MULTIPLE-NIP CALENDER AND CALENDERING ARRANGEMENT

(75) Inventors: Pekka Koivukunnas, Järvenpää (FI); Seppo Luomi, Järvenpää (FI); Pekka Linnonmaa, Järvenpää (FI); Mikko Tani, Tuusula (FI)

(73) Assignee: Metso Paper, Inc., Helsinki (FI)

( * ) Notice: Subject to any disclaimer, the term of this patent is extended or adjusted under 35 U.S.C. 154(b) by 0 days.

(21) Appl. No.: 10/239,491

(22) PCT Filed: Mar. 21, 2001

(86) PCT No.: PCT/FI01/00284

§ 371 (c)(1),
(2), (4) Date: Dec. 27, 2002

(87) PCT Pub. No.: WO01/71091

PCT Pub. Date: Sep. 27, 2001

(65) Prior Publication Data

US 2003/0101880 A1 Jun. 5, 2003

(30) Foreign Application Priority Data

Mar. 22, 2000 (FI) ..... 20000671

(51) Int. Cl.[7] ..... B30B 13/00; B30B 3/04; D21F 3/00

(52) U.S. Cl. ..... 100/35; 100/38; 100/161; 100/331; 162/206; 162/358.4; 162/358.5; 162/360.3

(58) Field of Search ..... 100/153, 155 R, 100/161, 162 R, 163 R, 162 B, 164–168, 327, 170, 172, 35, 38, 331; 162/205–207, 358.3, 358.4, 358.5, 360.2, 360.3

(56) References Cited

U.S. PATENT DOCUMENTS

| | | | | |
|---|---|---|---|---|
| 4,901,637 A | | 2/1990 | Hagel et al. | |
| 4,960,046 A | | 10/1990 | Anstötz et al. | |
| 5,163,364 A | | 11/1992 | Bubik et al. | |
| 5,483,873 A | | 1/1996 | Koivukunnas et al. | |
| 5,590,593 A | | 1/1997 | Korhonen et al. | |
| 5,938,895 A | | 8/1999 | Hirvonen | |
| 6,164,198 A | * | 12/2000 | Honkalampi et al. | 100/327 |
| 6,182,564 B1 | | 2/2001 | Gwosdz-Kaupmann | |
| 6,352,022 B1 | * | 3/2002 | Lau et al. | 100/35 |
| 6,397,739 B1 | | 6/2002 | Viljanmaa | |

FOREIGN PATENT DOCUMENTS

| | | |
|---|---|---|
| DE | 36 32 692 A1 | 4/1987 |
| DE | 43 44 165 A1 | 6/1995 |
| EP | 0 719 891 A2 | 7/1996 |
| EP | 0 967 324 A2 | 12/1999 |
| EP | 0 973 971 B1 | 11/2001 |
| FI | 81633 | 7/1990 |
| FI | 95061 | 8/1995 |
| FI | 102304 | 10/1998 |
| FI | 102305 | 10/1998 |
| FR | 2588293 | 4/1987 |
| WO | WO 01/71091 A1 | 9/2001 |

OTHER PUBLICATIONS

International Search Report issued in International Patent Application No. PCT/FI01/00284.
International Preliminary Examination Report issued in International Patent Application No. PCT/FI01/00284.
Search Report issued in Finnish Application No. 20000671.
PCT Written Opinion in International Application No. PCT/FI01/00284, Jan. 8, 2002.

* cited by examiner

*Primary Examiner*—Allen Ostrager
*Assistant Examiner*—Jimmy T Nguyen
(74) *Attorney, Agent, or Firm*—Stiennon & Stiennon

(57) ABSTRACT

A supercalender for calendering a paper web and a calendering arrangement for producing matte-quality paper web has a multiple-nip calender in which at least one of the calendering nips of the multiple-nip calender is an extended nip ($N_9$) formed between a polymer roll (18) and either a shoe roll (30) or a calendering belt.

13 Claims, 3 Drawing Sheets

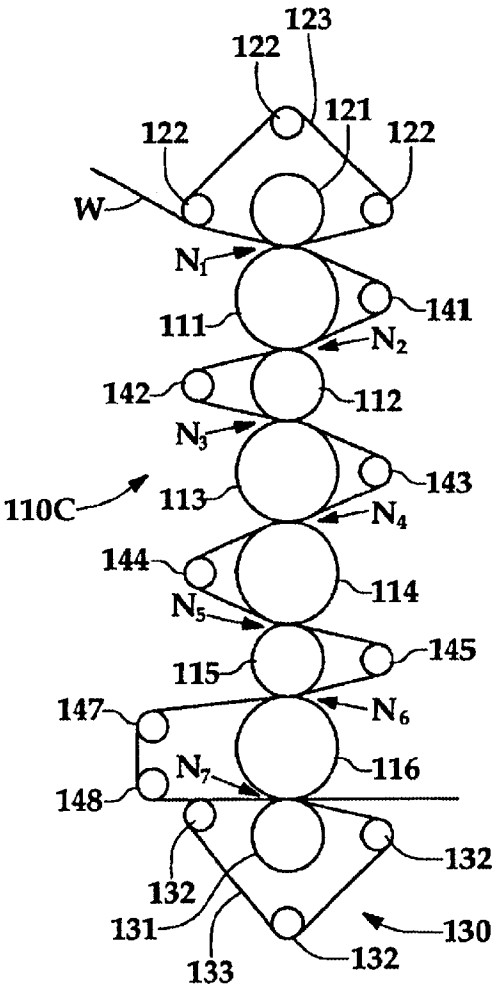
Fig.2A
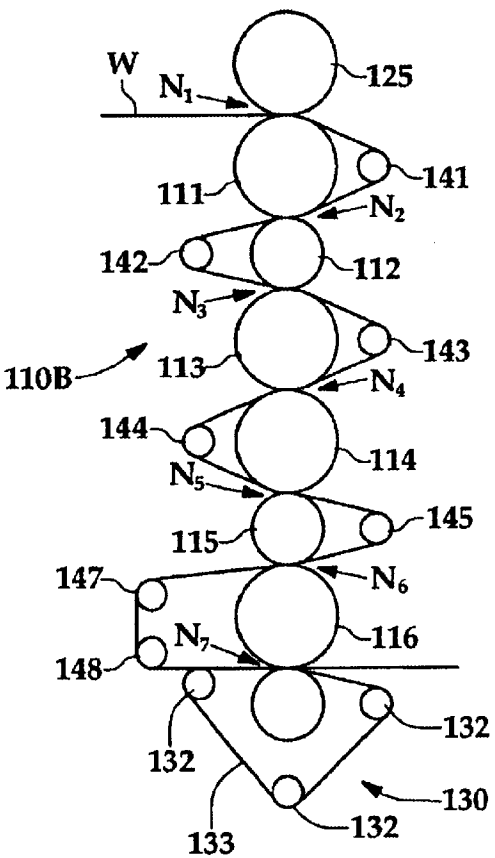
Fig.2B
Fig.2C

MULTIPLE-NIP CALENDER AND CALENDERING ARRANGEMENT

CROSS REFERENCES TO RELATED APPLICATIONS

This application is a U.S. national stage application of International Application No. PCT/FI01/00284, filed Mar. 21, 2001, and claims priority on Finnish Application No. 20000671, filed Mar. 22, 2000, the disclosures of both of which applications are incorporated by reference herein.

STATEMENT AS TO RIGHTS TO INVENTIONS MADE UNDER FEDERALLY SPONSORED RESEARCH AND DEVELOPMENT

Not applicable.

BACKGROUND OF THE INVENTION

The present invention relates to a multiple-nip calender, such as a supercalender, for producing a matte-quality paper web, said calender comprising a roll system composed of a plurality of rolls arranged to be in nip contact with each other or a corresponding roll stack, in which a paper web to calender the same is arranged to pass through the nips.

The roll system of a conventional supercalender comprises a number of rolls, usually eight to fourteen rolls, arranged into a superimposed roll stack. The superimposed rolls are in nip contact with each other and the paper web to be calendered is arranged to run through the nips between the rolls. Also, such supercalenders are known in the art in which the rolls of the roll system are so arranged that the nip level mainly common to the roll nips is arranged to be essentially horizontal instead of using a vertical roll stack. As regards the calendering result, it is not, however, of great importance whether a vertical or horizontal roll system is used. A highly conventional supercalender design is disclosed in, for example, Fl patent specification No. 81 633.

When wishing to raise the level of calendering with currently known designs, the sole possibility is, in fact, to increase the number of calendering nips in the supercalenders. This leads to a more complicated calender structure and to a more difficult control and tail threading of the paper web. Especially when on-line machines are in question, conflicts may be caused by the great running speed and full-speed tail threading. Endeavours have been made to solve the problems by, for example, different belt and shoe calenders, with which the calendering nip is extended and, therethrough, the activity of the nip is intensified. As to the state of art related to belt calenders, reference is made, for instance, to Finnish patent specifications Nos. 95 061, 102 304, and 102 305. As regards the state of the art related to shoe calenders, reference is made further to German application specification No. 43 44 165 and U.S. Pat. No. 5,163,364.

Using belt calenders and shoe calenders, a gloss corresponding to a supercalendered quality or fairly close to the gloss achieved by supercalendering is achieved, though achieving an equivalent smoothness is difficult. In order to avoid one-sidedness problems of the calendered paper, it is in general indispensable to use at least two extended nips provided with a belt or a shoe roll. In a belt and shoe calender nip, the maximum pressure will be lower thanks to the wider nip than in conventional nips formed between two rolls, because of which the belt and shoe calenders are best appropriate for paper grades in which the maintaining of bulk is of a great importance. They are thought to be particularly well appropriate for use in calendering cardboard.

According to the prior art, when calendering a paper web to achieve a matte-quality paper web, the calendering nip is formed between a polymer roll and a specially coated, heatable thermoroll or between two polymer rolls. The problem is now especially the short nip area in the running direction of the web involving detrimental resulting effects caused thereby in producing a matte-quality paper web.

SUMMARY OF THE INVENTION

A first objective of the present invention is to provide a novel solution in a multiple-nip calender, by which solution are provided as a combination those advantages which are related to current multiple-nip calenders and to e.g. belt and shoe calenders provided with an extended nip.

A second objective of the present invention is to provide a novel calendering arrangement for forming a calendering nip in order to make feasible production of matte-quality, that is, non-gloss and smooth paper web easier than before, especially a more easily controllable calendering when producing matte-quality paper web.

To achieve the objects of the invention, the multiple-nip calender of the invention mentioned at the beginning is mainly characterized in that at least the first and/or the last calendering nip of the multiple-nip calender is an extended nip.

With the present invention, a plurality of advantages are gained known in prior art technology, and for instance the following of said advantages may be introduced in the present context. In the invention the properties of an extended nip and a conventional supercalender are combined, whereby, especially when using an extended and low-pressure nip as the first nip of the calender, paper can be heated, plasticized and worked appropriately with this kind of extended and low-pressure nip prior to the actual nips of the supercalender. In this manner, the bulk of the paper can be saved without compromising over other quality-related characteristics. With the aid of the invention, the quality properties of superior paper are achieved in one and the same paper density. With an extended nip connected to the supercalender, the paper gloss is increased by reducing the microroughness. The gloss and smoothness of the paper are in general superior to conventional designs and the uniformity of pressed gloss is better than earlier. The calendering process is in general a highly "violent" measure considering the paper, but especially when a nip extended in the manner disclosed in the invention is used as a first nip of the supercalender, it will not cause stress to the paper to the extent the conventional nips do, whereby the structure of the paper will not suffer in the calendering. The strength properties of the paper remain good. With the design of the invention, more surface-directional forces are achieved and, on the strength of said surface-directional forces and plasticizing of the web, the smoothness of the paper to be calendered also exceeds the conventional level.

Of the advantages of the invention related to producing a matte-quality paper web, one may mention that an extended nip and, as a result of calendering, an excellent and non-gloss microsmoothness of the surface are achieved. However, the quality of the calendering result is limited in that if so-called Bendsen smoothness is desired, other calendering designs have to be used.

The other advantages and characteristic features of the invention become obvious in the following detailed description of the invention.

BRIEF DESCRIPTION OF THE DRAWINGS

The invention is described below in an exemplary fashion, reference being made to the figures of the accompanying drawings.

FIGS. 2A, 2B and 2C present various embodiments of the invention, in which in a multiple-nip calender such as a supercalender, at least one extended nip is arranged with the aid of a belt device including a calendering belt.

DESCRIPTION OF THE PREFERRED EMBODIMENTS

Figure 1C:
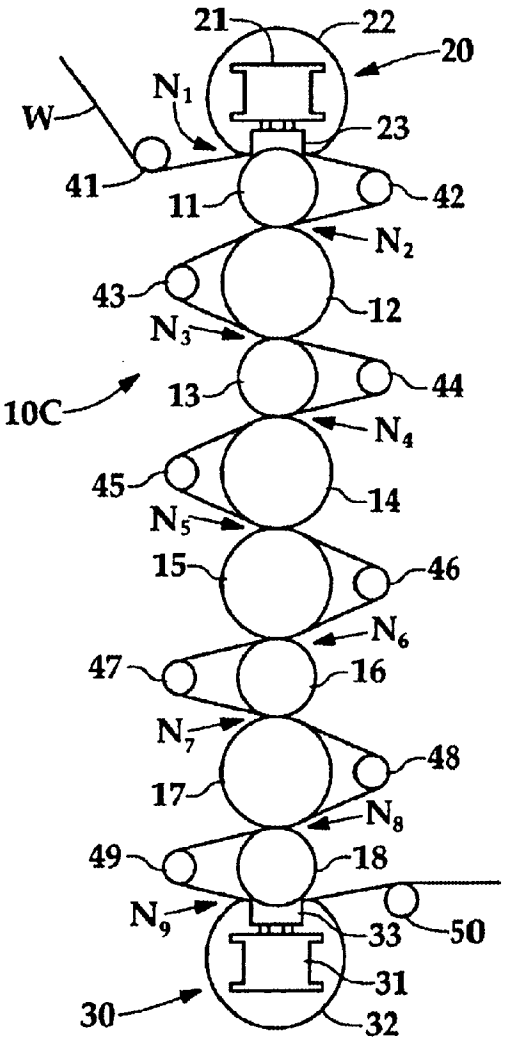
FIGS. 1A, 1B and 1C present various embodiments of the invention, in which in a multiple-nip calender such as a supercalender, at least one extended nip is arranged with the aid of an extended nip roll.
Figure 1B:
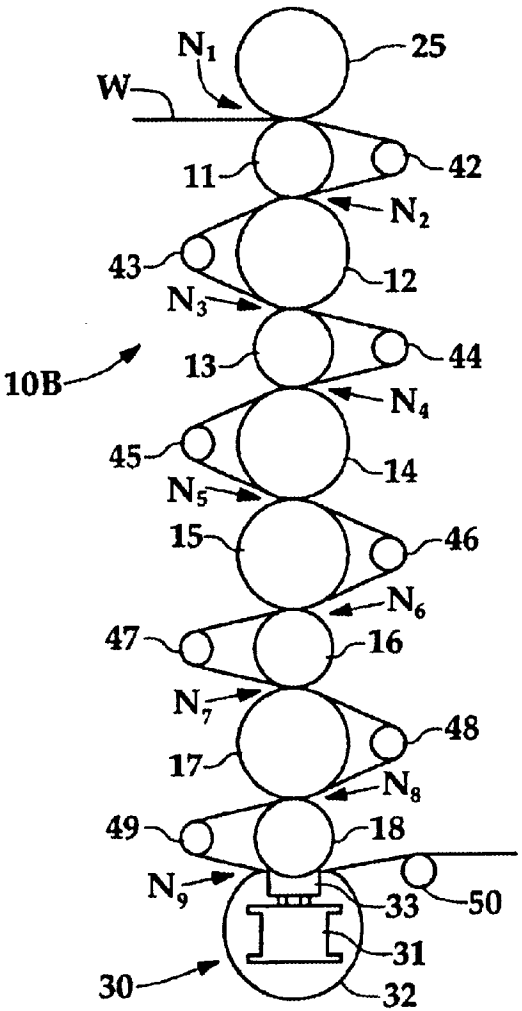
Figure 1A:
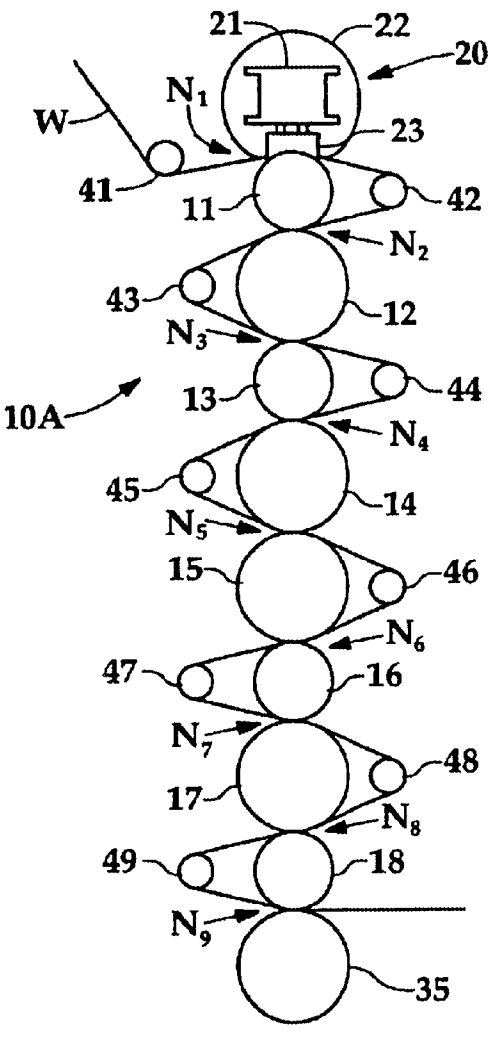

FIG. 1A is a completely schematic and principle presentation of a supercalender comprising a roll stack 10A composed of rolls arranged to be superimposed, in which the rolls of the roll stack form calendering nips $N_1$–$N_9$ therebetween, wherethrough a paper web W to be calendered is arranged to pass. In the presentation of FIG. 1A, a first nip $N_1$ of the supercalender is an extended nip formed between an extended nip roll 20 and a first intermediate roll 11 of the calender. In the present embodiment, the extended nip roll is advantageously a SymBelt™ roll. Said extended nip roll comprises a roll support 21, whereupon a flexible roll shell 22 is arranged to rotate, a so-called hose shell. Towards the nip $N_1$, the hose shell 22 is pressed with the aid of a formed compression shoe 23. A paper web W to be calendered is conducted to the first nip $N_1$ with the aid of a guide roll 41 and it is taken off from the nip by means of a pull-out roll 42 so that the paper web is released from the surface of the first intermediate roll 11. Respectively, after each nip the paper web is released from the surface of the calender roll with a pull-out roll 42, 43, 44, 45, 46, 47, 48, 49, and respectively, it is conducted from the pull-out roll to a subsequent nip. From the last nip $N_9$, being in FIG. 1A formed between the last intermediate roll 18 and the lower roll 35 of the supercalender, the paper web W is conducted for instance to a reeler.

FIG. 1B presents a principle image of a second embodiment of the invention, in which the roll stack of the supercalender is indicated by reference 10B. In the parts in which FIG. 1B is equivalent to FIG. 1A, the same references are used. In the embodiment of FIG. 1B, a first nip $N_1$, of the supercalender is a conventional roll nip formed between an upper roll 25 and a first intermediate roll 11 of the supercalender. In said embodiment, the last nip $N_9$ of the calender is an extended nip formed between the last intermediate roll 18 and the extended nip roll 30 used as the bottom roll. The extended nip roll is advantagoeusly a SymBelt™ roll. Thus, the extended nip roll 30 is equivalent in structure to the extended nip roll 20 presented in FIG. 2A in that the roll 30 comprises a roll support 31, on which a flexible roll shell is arranged to be rotating, a so-called "hose shell". The hose shell 32 is compressed against the last intermediate roll 18 with the aid of a formed press shoe 33 for forming the extended nip $N_9$. The web is taken out from said last nip $N_9$ with the aid of a guide roll 50.

FIG. 1C presents one more principle embodiment of the design of the invention. In FIG. 1C, the roll stack of the calender is denoted with reference 10C and the same reference numerals are used in FIG. 1C as in the parts in common in FIGS. 1A and 1C. The principle presentation of FIG. 1C is in a way a combination of the designs shown in FIGS. 1A and 1B in that in the present example both the first nip $N_1$ and the last nip $N_9$ of the supercalender are extended nips. Said extended nips $N_1$, $N_9$ are formed in a manner similar to those described in association with FIGS. 1A and 1B, in this aspect, reference is made to the description of FIGS. 1A and 1B.

FIG. 2A presents one more alternative embodiment of the design of the invention. In said presentation of FIG. 2A, being a completely principle image of the supercalender, the roll stack of the calender is marked with reference 110A. The presentation of FIG. 2A is to a large extent equivalent to the embodiment shown in FIG. 1A in that also in the presentation of FIG. 2A the first nip $N_1$ of the calender is formed into an extended nip. Said extended nip $N_1$ is provided with the aid of a belt device 122, 123, said belt device comprising a calender roll 121, around which a calendering belt 123 is conveyed, said belt being formed into an endless link and supported with the aid of guide rolls 122. Thus, the calendering belt 123 passes from the extended nip $N_1$ between the calender roll 121 and the first intermediate roll 111. The intermediate rolls of the calender are therefore indicated by reference numerals 111, 112, 113, 114, 115, and 116. As in the presentation of FIG. 2A, the paper web W is conducted to the first calendering nip $N_1$, from which it is taken out with the aid of a pull-out roll 141 and conducted to a subsequent calendering nip $N_2$, from which it is taken out with the aid of a subsequent pull-out roll, etc. So, the pull-out rolls are marked with reference numerals 141, 142, 143, 144, 145, and 146. Finally, the paper web is conducted to the last calendering nip $N_7$ formed between the last intermediate roll 116 and the lower roll 135 of the calender. From said last calendering nip, the paper web is guided e.g. to a reeler.

The embodiment of FIG. 2B is to a large extent equivalent to that shown in FIG. 1B in that the first nip $N_1$ of the calender also in FIG. 2B is a conventional roll nip formed between an upper roll 125 of the calender and a first intermediate roll 111. In the present embodiment, the last nip $N_7$ of the calender is, instead, an extended nip formed between a last intermediate roll 116 of the calender and the belt device 130. The belt device 130 in turn is equivalent to the belt device 122, 123 as in FIG. 2A in that the belt device 130 comprises a calender roll that is equivalent to calender roll 131 of FIG. 2C and wherearound a calendering belt 133 formed into an endless link is conveyed, said calendering belt being supported with the aid of guide rolls 132. In the presentation of FIG. 2B, the paper web passes in the manner equivalent to FIG. 2A between the nips $N_1$ through $N_7$ of the calender so that from the nip $N_6$ before the last nip of the calender the paper web is conducted with the aid of pull-out rolls 147 and 148 into an extended nip $N_7$ between the belt device 130 and the last intermediate roll 116. The roll stack of the calender is denoted with reference 110B. In other respects, the calender of said embodiment is equivalent to that shown in FIG. 2A and therefore, the equivalent parts are referred to by same reference numerals. In this respect, reference is thus made to the description of FIG. 2A.

FIG. 2C presents further an additional embodiment of the design of the invention and the calender presented in FIG. 2C is in a way a combination of the calenders of FIGS. 2A and 2B in that both the first nip $N_1$ and the last $nip_7$ of the calender of FIG. 2C are extended nips. Said extended nips $N_1$ and $N_7$ are formed with the aid of belt devices 122, 123 and 130 in the manner shown in FIGS. 2A and 2B. The roll stack of the calender is indicated by references 110C in FIG. 2C. In other respects, the embodiment of FIG. 2C is equivalent to that shown in FIGS. 2A and 2B and therefore, reference in the present context is made to the description of FIGS. 2A and 2B.

Figure 3:
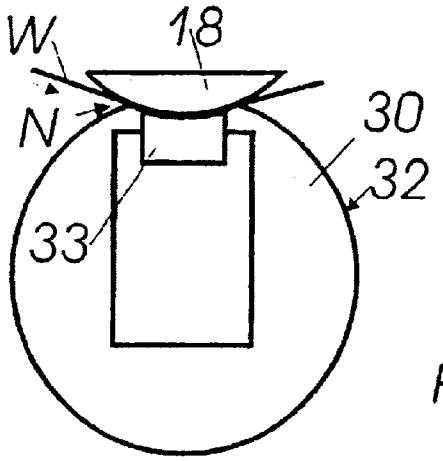
FIG. 3 presents an advantageous embodiment for producing a matte-quality paper web.

FIG. 3 presents a one-nip calender of an advantageous embodiment of the invention for coating a matte-quality paper web. A paper web W to be calendered is conducted in the direction shown by an arrow into a calendering nip N, which is an extended nip, formed between a rotating polymer roll 18 and a thin-shelled, flexible shoe roll 30 rotating about a fixed axial body. The shoe roll 30 is preferably an extended nip roll marketed by Metso Paper, Inc. under the trademark SymBelt™. The flexible shell of the shoe roll 30 is loaded by a radially inside formed loading shoe 33 disposed onto the axial body to be radially movable, with the aid of which the flexible shell 32 of the shoe roll 30 is pressed against the shoe roll 18. Thus, the polymer roll 18 acts as a stop roll to the shoe roll 30 for forming a calendering nip N.

Figure 4:
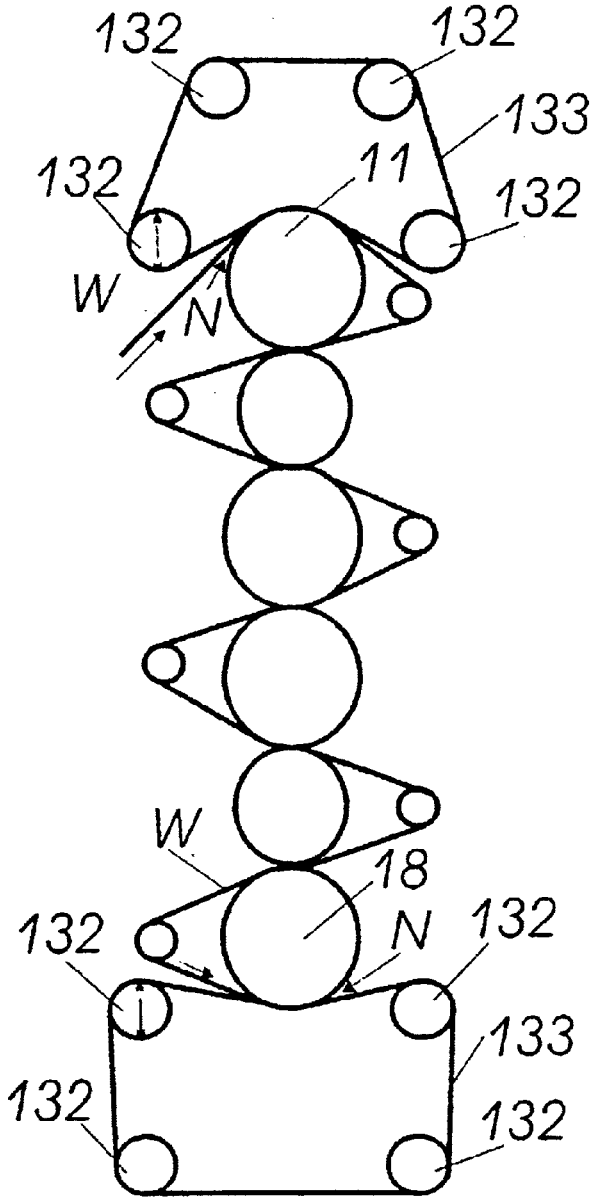
FIG. 4 presents a second advantageous embodiment for producing a matte-quality paper web.

FIG. 4 presents a multiple-nip calender of a second advantageous embodiment of the invention for coating matte-quality paper web. The paper web W to be calendered enters in the direction of an arrow into the calendering nip N, which is an extended nip and which in the embodiment of the figure is formed against the upper roll 11 and the bottom roll 18 of the calender. An advantagoues multiple-nip calender appropriate in the connection with the invention is the multiple-nip calender marketed by Metso Paper, Inc. under the trademark Optiload™. Both the upper roll and the bottom roll are polymer rolls and in said second embodiment of the invention, the calendering nip N is formed between a flexible calendering belt 133, arranged to be pressed against the polymer roll 11 and 18 with the aid of tension devices. Thus, the polymer roll 11 and 18 serves also in the calendering arrangement of the present embodiment as a stop roll for forming a calendering nip N. As can be seen in the figure, for the tension devices of the calendering belt 133, a first, second, third and fourth guide roll 132 are used in the second embodiment of the invention, around which the endless calendering belt 133 passes. One of the guide rolls, the first top left guide roll 132 in the nip N against the bottom roll 18 and the guide roll 132 down on the left in the nip N against the upper roll 11, can be positioned in vertical direction, whereby the tension of the calendering belt 3 and pressing against the polymer roll 11 or 18 acting as the stop roll as well as the length of the calendering nip N can be adjusted.

As advantageous embodiments of the invention a one-nip calender may be furthermore mentioned, whereby the calendering nip of the invention having the capacity to produce matte quality is the only nip of the calender, and a multiple-nip calender, whereby advantageous targets for application is the forming of a calendering nip of the invention producing matte quality against the upper roll of a multiple-nip calender or against a bottom roll of a multiple-nip calender.

The invention is described in the foregoing in exemplary fashion, referring to the figures of the accompanying drawing. However, the invention is not restricted to concern solely to the examples associated with supercalenders presented in the figures, instead, various embodiments of the invention may, related to various multiple-nip calendars, be varied within the inventive idea determined in the accompanying claims.

What is claimed is:

1. A multiple-nip calender, for producing a matte-quality paper web, said calender comprising:

a roll system having a plurality of rolls arranged to be in nip contact with each other, the rolls forming a plurality of nips, through which a paper web to be calendered is arranged to pass, wherein at least the first or the last calendering nip of the multiple-nip calender is an extended nip;

wherein the extended nip is formed between one of said plurality of rolls which is a polymer roll and a flexible hose shell arranged to rotate about a roll support, the shell being compressable against the polymer roll by a compression shoe mounted to the roll support.

2. The multiple-nip calender of claim 1 wherein each of the first and the last calendering nip of the multiple-nip calender is an extended nip formed between one of the plurality of rolls which is a polymer roll and a flexible hose shell arranged to rotate about a roll support, the shell being compressible against the bottom roll by a compression shoe mounted to the roll support.

3. A supercalender for producing a matte-quality paper web comprising:

an upper roll which is a polymer roll and a bottom roll which is a polymer roll;

at least one intermediate roll between the upper roll and the bottom roll, wherein each of the upper roll and the bottom roll form a nip with one of the at least one intermediate roll; and an extended nip engaged against at least one of the upper roll and the bottom roll to define either the first or the last nip of the supercalender, wherein the paper web to be calendered passes through said extended nip and the nips formed with the at least one intermediate roll, wherein the extended nip is of the type formed by a flexible hose shell arranged to rotate about a roll support, the shell being compressable against the at least one of the upper roll and the bottom roll by a compression shoe mounted to the roll support, or the extended nip is of the type formed by an endless flexible calendering belt arranged to be pressed against the at least one of the upper roll and the bottom roll by a plurality of guide rolls which do not engage the at least one of the upper roll and the bottom roll.

4. The supercalender of claim 3 wherein both the upper roll and the bottom roll are engaged with an extended nip such that both the first and the last nip of the supercalender are formed with extended nips.

5. A multiple-nip calender, for producing a matte-quality paper web, said calender comprising:

a roll system having a plurality of rolls arranged to be in nip contact with each other, the rolls forming a plurality of nips, through which a paper web to be calendered is arranged to pass, wherein at least the first or the last calendering nip of the multiple-nip calender is an extended nip; and wherein the extended nip is formed between one of said plurality of rolls which is a polymer roll and is an uppermost roll or a lowermost roll, and an endless flexible calendering belt arranged to be pressed against the polymer roll with a plurality of guide rolls which do not engage any of said plurality of rolls.

6. A method of producing a one-sided matte-quality paper web comprising the steps of:

passing a web through an extended nip formed between a polymer roll which forms a top roll of a supercalender, and a flexible hose shell arranged to rotate about a roll support, the shell being compressed against the top roll by a compression shoe mounted to the roll support; and passing the paper web through each of a plurality of nips formed in the supercalender by a plurality of rolls, wherein the web after leaving the supercalender is the one-sided matte-quality web.

7. The method of claim 6 further comprising the step of passing the web through a second extended nip formed between a polymer roll which forms a bottom roll of the supercalender, and a flexible hose shell arranged to rotate about a roll support, the shell being compressed against the bottom roll by a compression shoe mounted to the roll support.

8. A method of producing a one-sided matte-quality paper web comprising the steps of:

passing a paper web through each of a plurality of nips formed in a supercalender by a plurality of rolls; and passing the web through an extended nip formed between a polymer roll which forms a bottom roll of the supercalender, and a flexible hose shell arranged to rotate about a roll support, the shell being compressed against the bottom roll by a compression shoe mounted to the roll support, wherein the web after leaving the extended nip is the one-sided matte-quality web.

9. A method of producing a one-sided matte-quality paper web comprising the steps of:

passing a web through an extended nip formed between a polymer roll which forms a top roll of a supercalender, and an endless flexible calendering belt arranged to be pressed against the polymer roll with the aid of a plurality of guide rolls which do not engage the polymer roll; and passing the paper web through each of a plurality of nips formed in the supercalender by a plurality of rolls, wherein the web after leaving the supercalender is the one-sided matte-quality web.

10. The method of claim 9 further comprising the step of passing the web through a second extended nip formed between a polymer roll which forms a bottom roll of the supercalender, and an endless flexible calendering belt arranged to be pressed against the polymer roll with the aid of a plurality of guide rolls.

11. A method of producing a one-sided matte-quality paper web comprising the steps of:

passing a paper web through each of a plurality of nips formed in a supercalender by a plurality of rolls; and passing the web through an extended nip formed between a polymer roll which forms a bottom roll of the supercalender, and an endless flexible calendering belt arranged to be pressed against the polymer roll with the aid of a plurality of guide rolls which dose not engage the polymer roll, wherein the web after leaving the extended nip is the one-sided matte-quality web.

12. A method of producing a one-sided matte-quality paper web comprising the steps of:

passing a paper web through each of a plurality of nips formed in a supercalender by a plurality of rolls; and passing the web through an extended nip formed between a specially coated, heatable thermoroll which forms a bottom roll or a top roll of the supercalender, and a flexible hose shell arranged to rotate about a roll support, the shell being compressed against the bottom roll or the top roll by a compression shoe mounted to the roll support, wherein the web after leaving the extended nip is the one-sided matte-quality web.

13. A method of producing a one-sided matte-quality paper web comprising the steps of:

passing a paper web through each of a plurality of nips formed in a supercalender by a plurality of rolls; and passing the web through an extended nip formed between a polymer roll which forms a bottom roll or top roll of the supercalender, and a flexible hose shell arranged to rotate about a roll support, the shell being compressible against the polymer roll by a compression roll mounted for rotation wherein the web after leaving the extended nip is the one-sided matte-quality web.

* * * * *